US007924152B1

(12) United States Patent
Daniel

(10) Patent No.: US 7,924,152 B1
(45) Date of Patent: Apr. 12, 2011

(54) INTERACTIVE VIDEO GAMING FOOTWEAR INCLUDING MEANS FOR TRANSMITTING LOCATION INFORMATION TO A REMOTE PARTY

(76) Inventor: Sayo Isaac Daniel, Miami, FL (US)

( * ) Notice: Subject to any disclaimer, the term of this patent is extended or adjusted under 35 U.S.C. 154(b) by 828 days.

(21) Appl. No.: 11/669,946

(22) Filed: Feb. 1, 2007

Related U.S. Application Data

(63) Continuation-in-part of application No. 10/979,894, filed on Nov. 1, 2004, now Pat. No. 7,265,666, and a continuation-in-part of application No. 11/619,189, filed on Jan. 2, 2007, and a continuation-in-part of application No. 11/626,356, filed on Jan. 23, 2007.

(51) Int. Cl.
*G08B 1/08* (2006.01)
*G08B 23/00* (2006.01)

(52) U.S. Cl. ..... 340/539.13; 340/539.1; 340/539.11; 340/573.1

(58) Field of Classification Search ..... 340/573.1, 340/573.4, 539.1–539.15
See application file for complete search history.

(56) References Cited

U.S. PATENT DOCUMENTS 5,748,087 A * 5/1998 Ingargiola et al. ..... 340/573.7
5,771,001 A * 6/1998 Cobb ..... 340/573.1
5,838,237 A * 11/1998 Revell et al. ..... 340/573.1
6,362,778 B2 * 3/2002 Neher ..... 342/357.07
6,363,320 B1 * 3/2002 Chou ..... 701/207
6,690,262 B1 * 2/2004 Winnett ..... 340/7.1
6,788,200 B1 * 9/2004 Jamel et al. ..... 340/539.13
6,812,840 B2 * 11/2004 Gehlot et al. ..... 340/572.1
6,819,258 B1 * 11/2004 Brown ..... 340/825.49
6,871,144 B1 * 3/2005 Lee ..... 701/213
2003/0078054 A1 * 4/2003 Okuda ..... 455/456
2004/0074966 A1 * 4/2004 Holzer ..... 235/385

* cited by examiner

*Primary Examiner* — Benjamin C Lee
*Assistant Examiner* — Michael Shannon
(74) *Attorney, Agent, or Firm* — Sanford Jay Asman

(57) ABSTRACT

An article of footwear contains an integrated video gaming apparatus, a cellular phone, and a GPS receiver, whereby the footwear is able to encode and transmit its own location to a central monitoring station, along with a cell phone number (or other unique identifier) of a remote person. Using the encoded location information of the wearer of the footwear, and the encoded cell phone number of the remote person, the central monitoring station is able to look up the nearest street address corresponding to the location of the wearer and send an SMS text message with that address to the remote person. If the remote person is wearing the inventive footwear, the central monitoring station can send the remote person the street address of the wearer, or route information, with or without map data, for display on their video gaming device, such that they can "intercept" to meet up with one another.

8 Claims, 4 Drawing Sheets

INTERACTIVE VIDEO GAMING FOOTWEAR INCLUDING MEANS FOR TRANSMITTING LOCATION INFORMATION TO A REMOTE PARTY

CROSS-REFERENCE TO RELATED APPLICATIONS

The present application is a continuation-in-part of U.S. patent application Ser. No. 10/979,894 entitled FOOTWEAR COVERT ALARM AND LOCATOR APPARATUS filed Nov. 1, 2004 by Sayo Isaac Daniel; it is a continuation-in-part, also, of U.S. patent application Ser. No. 11/619,189 entitled FOOTWEAR WITH INTEGRATED GAMING APPARATUS filed Jan. 2, 2007; and it is a continuation-in-part, also, of U.S. patent application Ser. No. 11/626,356 entitled BACKPACK HAVING A COVERT ALARM AND LOCATOR APPARATUS filed Jan. 23, 2007 the priority of each of which is claimed and the contents of each of which are hereby incorporated by reference.

BACKGROUND OF THE INVENTION

The present invention relates to a system for using footwear having integrated video gaming capability, including a location determining apparatus, together with a central monitoring station as a way to interact with others in location based activities. In particular, the present invention is a system which enables a user of the system to automatically initiate the transmission of a text message, such as a by using the "Short Message System" ("SMS") protocol, which is available over most digital cell phones (as well as many other handheld devices) to send the user's street address to the recipient. Alternatively, the present invention can be used with a second user to send the first user's street address to the second user, or to send routing or map information to a video gaming device of the second user, with such data dynamically updated as the first user changes location.

As explained in the referenced co-pending patent applications of the present inventor, footwear employing location determining apparatus, such as a global positioning system ("GPS") receiver, together with communications capabilities, such as a cellular phone module, together with a central monitoring system, can be used to send a covert signal indicative of an alarm condition indicative of the wearer's location and the fact that the wearer is in a distress situation. Other technology disclosed in the referenced co-pending applications describes how to use such technology in conjunction with interactive video gaming capabilities.

While the disclosures contained in the co-pending applications describe both interactive gaming and the ability to send a covert alarm to a central monitoring station, nothing in the prior art, or in the co-pending applications permits the wearer of a GPS enabled shoe to be able to send specific location information to someone who simply has a text message enabled cell phone.

Thus, while it is possible, in the prior art, for someone who knows his own location to call a friend and tell them to meet at that location, it has not been possible to do that where the person seeking to be met, simply does not know the address where he happens to be. While standard GPS technology can be used to determine one's location as a latitude and longitude, and while such "lat-long" information is useful when looking at a map or when used by a monitoring station equipped to translate lat-long information into addresses or other location information, it simply does not fit well in everyday parlance. A person wanting to know the location of a friend who he is to be meeting really wants to know the friend's street address, rather than his lat-long.

A need, therefore, exists for some means to provide street address information to others who, while remote, are possessed of a cell phone having text messaging capability, such as SMS.

SUMMARY OF THE INVENTION

The present invention is an article of footwear which includes a location determining apparatus, such as a GPS receiver; a communication means having at least transmitter capability, such as a cell phone or satellite phone; an encoding and control means for encoding the location information and causing a location encoded signal to be transmitted by the communication means to a central monitoring station; a central monitoring station which is able to translate the encoded location information, which is generally in the form of latitude-longitude ("lat-long") data, into a street address, and means for transmitting a text message having the decoded street address to a cell phone located at the central monitoring station.

In a first alternative embodiment, the invention can be used to communicate the user's location to a second user of the invention, whereby the second user will receive a message on his video display including the first user's street address.

In another embodiment of the invention, where the user and a second user each have the invention, the address of the first user, which can be changing dynamically as the first user moves, can be presented to the second user as directions or a moving map display so that the second user receives dynamically updated "intercept" guidance to the first user, even while the first user is in motion.

DETAILED DESCRIPTION OF THE PREFERRED EMBODIMENTS

Figure 1:
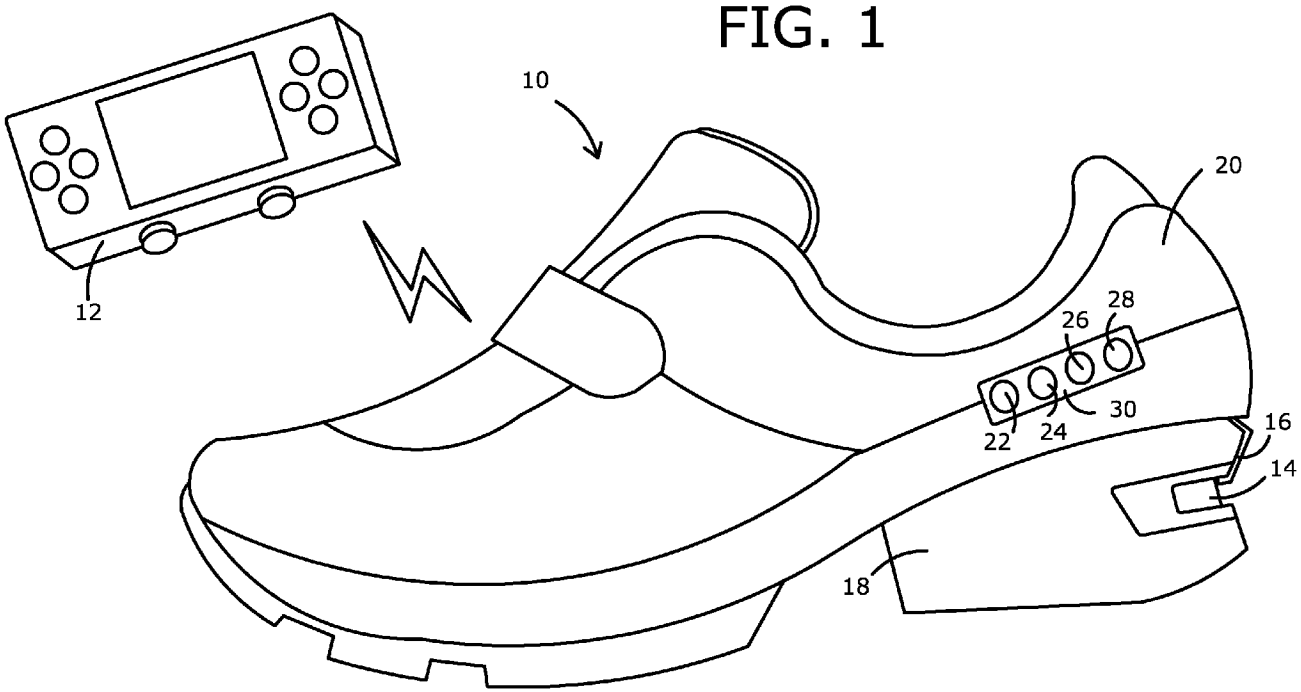
FIG. 1 is a perspective view of an athletic shoe including the present invention.

Referring to FIG. 1, the present invention relates to an article of footwear, preferably in the form of athletic footwear, such as the running shoe 10 shown. The shoe 10 differs from a standard running shoe in that it has been designed to include means for interactive communication with a video gaming device, particularly a handheld electronic video gaming device 12, such as a Sony PSP. As will be understood by those skilled in the art, interactive communication between the footwear 10 and the gaming device 12 can be accomplished by any of a variety of means, such as by Wi-Fi communications, as used in the preferred embodiment of the invention, as the Sony PSP is inherently capable of Wi-Fi communication.

The article of footwear 10 preferably includes removable storage means 14, which can be in the form of a memory card or miniature hard drive unit, depending on the amount of storage needed. In the preferred embodiment of the invention, the storage means 14 comprises a hard drive, which provides several gigabytes of storage whereby numerous programs, including games, as well as data, can be stored. When a hard drive is used as the removable storage means, a mechanical locking structure 16 can be provided to insure that the hard drive 14 remains firmly seated in the heel portion 18 of the footwear 10.

As illustrated in FIG. 1, the article of footwear 10 further includes an upper portion 20 which is shown to have a series of push-button switches 22, 24, 26, 28 which are covered, in the preferred embodiment, with a protective clear cover 33.

Figure 2:
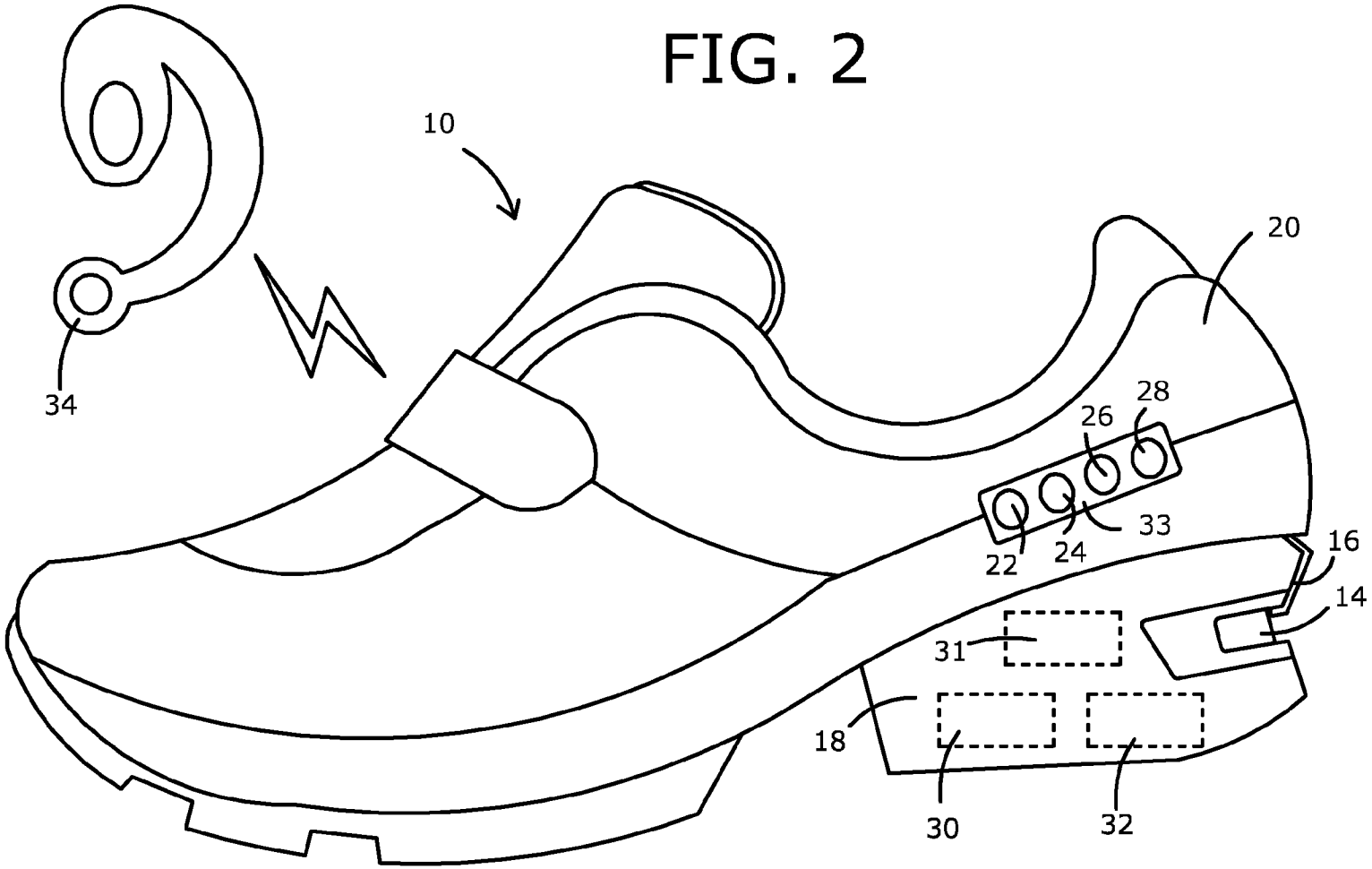
FIG. 2 is a perspective view of an athletic shoe including the present invention, along with a GPS receiver and a cellular telephone transceiver.

Referring now to FIG. 2, the present invention includes means for determining its own location, such as a GPS receiver 30, which provides the footwear 10 with its present position (latitude, longitude, elevation). The present invention also contemplates the inclusion of a cellular telephone transceiver 32 which is preferably mounted in the heel 18, along with the GPS receiver 30. The cellular telephone transceiver 32 allows the user to communicate by voice with other players, or, alternatively, it allows the wearer of the footwear 10 to signal a distress situation, as described in the parent application. When the cellular transceiver 32 is used for voice, it is preferably connected to a headpiece 34 via Bluetooth, as is well known in the art.

As explained more fully in the parent applications referenced above, the invention is designed to be able to communicate its location information to a central monitoring location. Accordingly, in a situation in which the wearer of the shoe 10 is in danger, he can covertly initiate an alarm signal to the central monitoring station where trained personnel will dispatch emergency assistance to the wearer's location, as set forth in the encoded alarm system. The functionality between the GPS module 30 and the transceiver 32 is administered by an encoder and control module 31, which typically includes a programmed microprocessor, and which is able to control both the GPS functions and the cell phone functions in response to either remote commands received by radio or local commands which are input by the user. As the specific functionality of the encoder and control module 31 is well within the skill of those in the art who have been made aware of the present inventive concept, no detailed explanation is needed, other than to state that the encoder and control module 31 provides a means for accomplishing the functions described herein.

The present invention is also capable of performing more mundane operations, such as providing the wearer's location to someone else, e.g., a friend who the wearer is talking to on the cell phone 32 or to someone with whom the wearer is playing a video game using the gaming device 12, provided, of course that in the case of the friend with the cell phone, the friend's cell phone is able to accept text messages, typically in the form of SMS text messages, which are generally available on cell phones. In the case of the person playing a video game, additional capabilities can be provided, as explained below.

Figure 3:
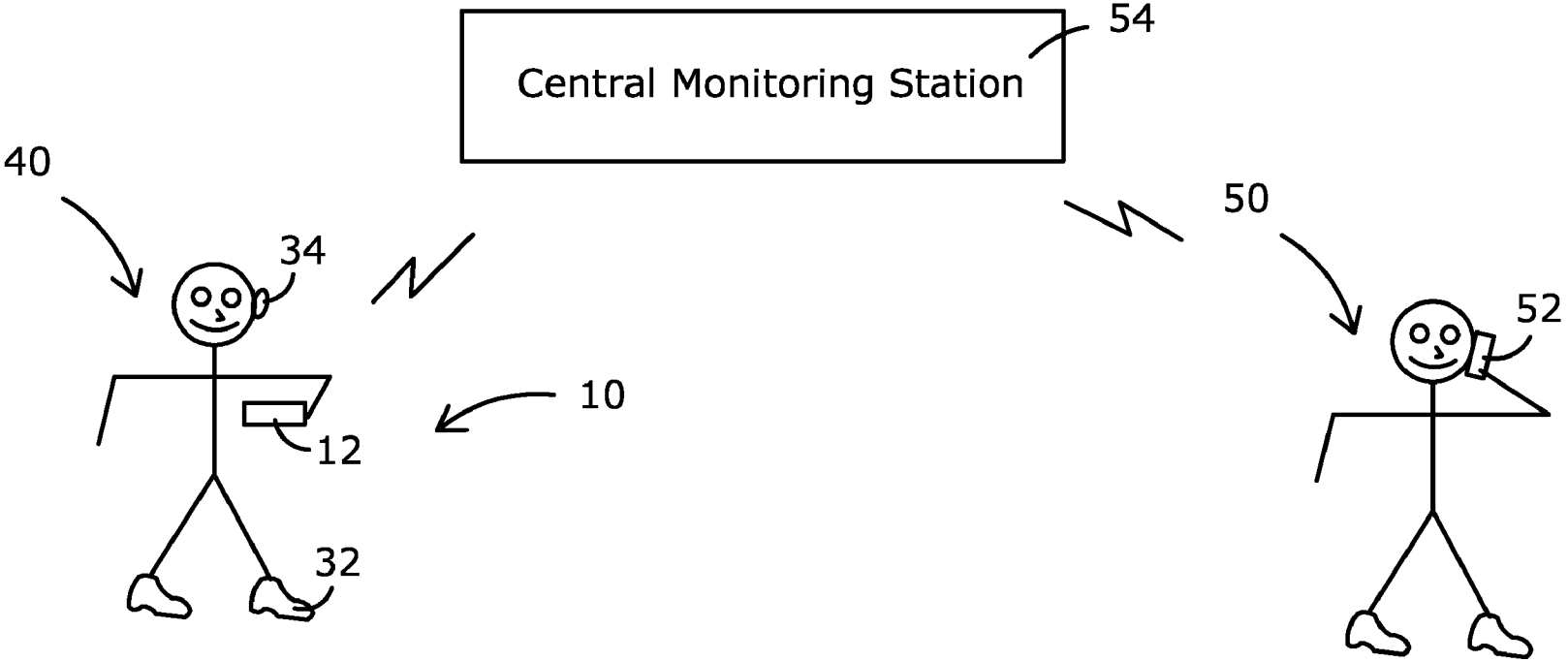
FIG. 3 is an illustration showing one way in which the present invention can be used to provide a friend with an SMS text message of the user's street address.

First, though, with reference to FIG. 3, assuming that the wearer 40 of the shoe of the present invention 10 is speaking on the cell phone 32 with a friend 50 who is on a conventional cell phone 52 which has SMS text messaging capability, then the cell phone 32 will generally already "know" the phone number of the cell phone 52 of the friend 50, either because the call was made to the friend 50, in which case the cell phone 32 will have stored the last number called, or, alternatively, if the friend 50 called the wearer from his cell phone 52, the cell phone 32 will have the last incoming phone number from the "caller id" function of the cell phone network. From the GPS information available from the GPS module 30 in the invention 10 the invention 10 also knows (or can readily determine) its own location which it is able to encode on a signal which it transmits, on demand of the user 40, who can command the transmission using buttons on the video gaming device 12 or buttons on the shoe 10 to thereby transmit the user's 40 location to a central monitoring station 54. Unlike an alarm signal however, this type of signal is also encoded with the number of the cell phone 52 of the friend 50, so that the monitoring equipment in the central monitoring station 54 does not alert the personnel there to take action, but, instead, converts the encoded latitude-longitude ("lat-long") location information received from the user's 40 shoe 10 into the nearest street address of the wearer 40 of the shoe 10. This is accomplished at the central monitoring station 54 where a computerized database uses the lat-long location data to obtain the nearest street address, which it then converts into a text message, which is sent to the cell phone 52 of the friend 50, using the encoded phone number provided on the encoded signal. This transmission, from the central monitoring station 54 to the friend's 50 cell phone 52 can generally be accomplished using the Internet, or, alternatively, it can be accomplished using the cell phone network. Thus, when the wearer 40 tells his friend 50 that he 40 is waiting to meet the friend 50 at the place where the wearer 40 is then located, it is not necessary for the wearer 40 to even know the street address where he 40 is located.

Figure 4:
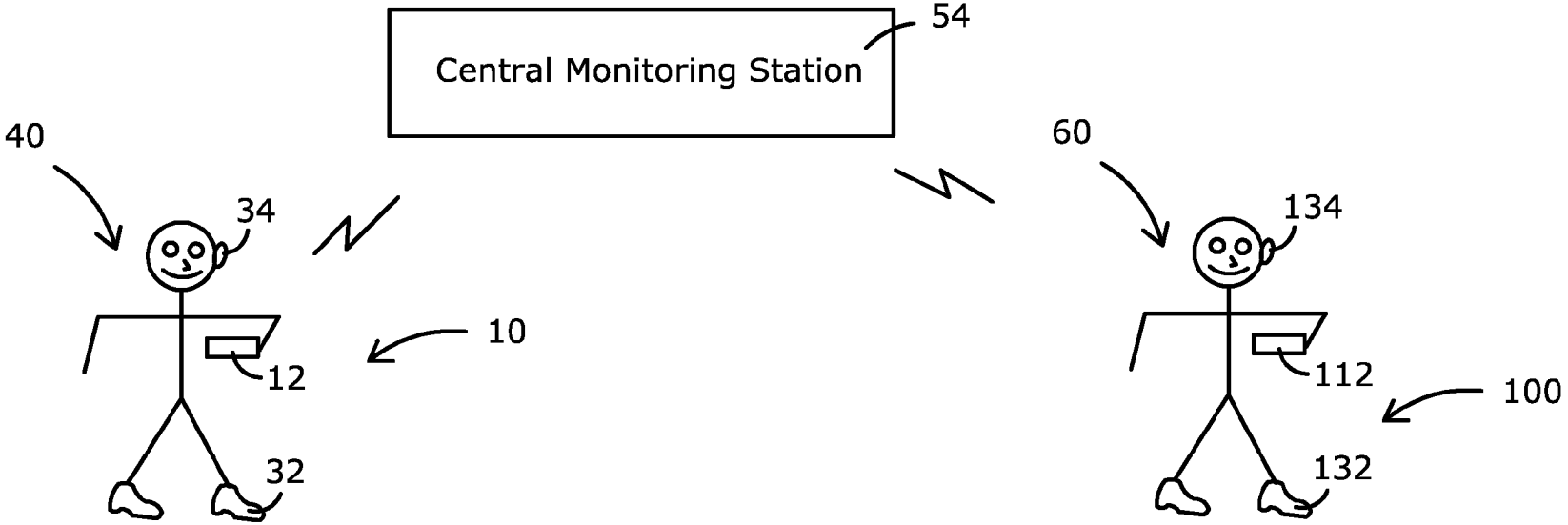
FIG. 4 is an illustration showing how the present invention can be used by two individuals each of whom has the present invention to provide "intercept" information graphically and/or in a text format.

Referring now to FIG. 4, in another embodiment of the invention, where the friend 60 is wearing a shoe 100 which also includes the invention, a number of additional features are available, as the central monitoring station 54 can track both the location of the user 40 and the location of the friend 60. In this situation, the following additional features become available. First, the central monitoring station 54 can send a text message to the friend 60, as described above, but in this case the text message can be displayed on the screen of the friend's video gaming device 112. Alternatively, the central monitoring station 54 can create and transmit to the friend 60, a detailed list of directions to direct the friend 60 from his own present position to the location of the user 40. These directions can be displayed either as a route, or as a map, or as a joint map and route display with turn-by-turn instructions on the video gaming device 112 of the friend 60. Finally, if the two parties 40, 60 decide to remain in motion, the central monitoring station 54 is able to continuously update and transmit "intercept" data to the friend's 60 gaming device 112 even while the user 40 is moving. Unlike a standard GPS navigation system which uses a fixed location from a database to provide a user with directions to that fixed location from the user's "present position", when the present invention is used in the "intercept" mode it continuously updates the destination (i.e., the location of the user 40) as it is able to simultaneously monitor both the location of the user 40 (who may be in motion), along with the location of the friend 60. Obviously, in this mode, the location information of the friend 60 can also be displayed on the video gaming unit 12 of the user 40, whereby they can simultaneously alter their positions to speed up their "intercept" of one another.

As will be understood by those skilled in the art, the variety of games which can be played using the present invention is not limited by the hardware herein described but only by the imagination of the software developers.

While the invention has been described in connection with specific embodiments and applications, the inventor does not intend to restrict the description to the examples shown. Persons skilled in the art will recognize that the above apparatus and methods may be modified or changed without departing from the general scope of the present description, the intention of the inventor being to include all such modifications and alterations in so far as they come within the scope of the appended claims or the equivalents thereof.

I claim:

1. An article of footwear intended to be worn by a wearer, including therein:

(a) a location determining apparatus for determining location information of the wearer;

(b) a communication means having at least transmitter capability;

(c) an encoding and control means for encoding the location information of the wearer of said article of footwear and for causing a location encoded signal to be transmitted by the communication means to a central monitoring station, said encoded signal also including a remote user identifier designated by the wearer of said footwear, said central monitoring station including a database for converting said location information into a street address; and (d) means for transmitting said location information of said wearer from said encoding and control means to said central monitoring station by using said remote user identifier, said means for transmitting said location information of said wearer being included within said article of footwear and, further, including means within said central monitoring station for communicating said location of said wearer to a remote user.

2. The article of footwear of claim 1, wherein said communication means comprises a cellular telephone.

3. The article of footwear of claim 2, wherein said location determining apparatus comprises a GPS receiver.

4. The article of footwear of claim 3, wherein said remote user identifier is a cell phone number.

5. The article of footwear of claim 4, wherein said central monitoring station includes means for translating said location information into a street address as a text message and means for transmitting said street address to said remote user by sending a text message with said street address to said cell phone number.

6. The article of footwear of claim 5, wherein said means for transmitting said street address within said central monitoring station includes means for converting said text message into an SMS message.

7. The article of footwear of claim 6 wherein said means for transmitting said street address uses the internet to transmit said SMS message.

8. The article of footwear of claim 6 wherein said means for transmitting said street address uses a cellular telephone network to transmit said SMS message.

* * * * *